US010174941B2

(12) United States Patent
Su et al.

(10) Patent No.: US 10,174,941 B2
(45) Date of Patent: Jan. 8, 2019

(54) RIBBON PACK FOR GAS BURNERS

(71) Applicant: SELAS HEAT TECHNOLOGY COMPANY LLC, Streetsboro, OH (US)

(72) Inventors: Guoguang Su, Aurora, OH (US); Steve Mathis, Aurora, OH (US); Chris Edward Vandegrift, Milford, OH (US); James Pezzuto, Hastings-on-Hudson, NY (US); Matthew M. Knepper, Windham, OH (US)

(73) Assignee: SELAS HEAT TECHNOLOGY COMPANY LLC, Streetsboro, OH (US)

( * ) Notice: Subject to any disclaimer, the term of this patent is extended or adjusted under 35 U.S.C. 154(b) by 0 days.

(21) Appl. No.: 15/258,719

(22) Filed: Sep. 7, 2016

(65) Prior Publication Data

US 2018/0066843 A1 Mar. 8, 2018

(51) Int. Cl.

| | |
|---|---|
| ***F23D 14/04*** | (2006.01) |
| ***F23D 14/58*** | (2006.01) |
| ***F23D 14/84*** | (2006.01) |
| *F23D 14/10* | (2006.01) |

(52) U.S. Cl.

CPC ..... *F23D 14/586* (2013.01); *F23D 14/04* (2013.01); *F23D 14/84* (2013.01); *F23D 14/10* (2013.01)

(58) Field of Classification Search

CPC ..... F23D 14/04; F23D 14/10; F23D 14/84
USPC ..... 431/350, 352, 18, 191; 126/91 A, 271
See application file for complete search history.

(56) References Cited

U.S. PATENT DOCUMENTS 1,400,024 A * 12/1921 Caracristi ..... F23D 14/00 144/145.1
1,830,464 A * 11/1931 Guenther ..... F23D 14/586 431/285
2,228,114 A 1/1941 Hess
2,428,271 A 9/1947 Ensign et al.
(Continued)

FOREIGN PATENT DOCUMENTS

GB 2042310 A * 10/1980 ..... H05B 6/76
JP 10110913 A * 4/1998 ..... F23D 14/08
(Continued)

OTHER PUBLICATIONS

WO 2018/048776, Written Opinion of the International Searching Authority.
WO 2018/048776, International Search Report.

*Primary Examiner* — Gregory Huson
*Assistant Examiner* — Nikhil Mashruwala
(74) *Attorney, Agent, or Firm* — Bond, Schoeneck & King, PLLC

(57) ABSTRACT

A gas burner system comprising a longitudinal burner body defining a longitudinal central cavity, and a ribbon pack configured to be removably installed into the central cavity, the ribbon pack comprising: (i) at least one ribbon positioned between a first vertical wall and a second vertical wall; (ii) a first transverse arm extending horizontally outward from a first longitudinal side of the ribbon pack; (iii) a second transverse arm extending horizontally outward from a second longitudinal side of the ribbon pack, wherein the first and second transverse arms are configured to attach to the longitudinal burner body.

20 Claims, 6 Drawing Sheets

(56) References Cited

U.S. PATENT DOCUMENTS 2,607,405 A 8/1952 Weinandy
2,647,569 A 8/1953 Flynn
4,432,727 A * 2/1984 Fraioli ..... F24C 3/047 126/91 A
4,729,618 A * 3/1988 Yoshida ..... G02B 6/12004 385/14
4,904,179 A * 2/1990 Drago ..... F23D 14/70 126/110 R
5,346,389 A * 9/1994 Retallick ..... B01J 35/04 431/170
5,415,233 A * 5/1995 Roussakis ..... A62C 4/02 169/48
5,546,925 A * 8/1996 Knight ..... F23D 14/70 126/110 R
5,636,981 A * 6/1997 Lilly ..... F23D 11/102 239/427
5,661,905 A * 9/1997 Nakaura ..... F23D 14/045 29/428
6,200,131 B1 * 3/2001 Birch ..... F23C 5/02 239/450
6,918,759 B2 * 7/2005 Cho ..... F23D 14/105 431/154
7,635,264 B2 * 12/2009 Strobel ..... B26D 5/00 431/11
7,955,073 B2 * 6/2011 Leinemann ..... A62C 4/02 29/428
8,092,213 B2 * 1/2012 Leinemann ..... A62C 4/02 126/85 R
8,105,077 B2 * 1/2012 Bannos ..... F23D 14/12 126/39 E
9,551,488 B2 * 1/2017 Akagi ..... F23D 14/586
9,731,155 B2 * 8/2017 Riordan ..... A62C 3/065
2009/0162802 A1 5/2009 Strobel et al.
2017/0248306 A1 * 8/2017 Walker ..... F23D 23/00

FOREIGN PATENT DOCUMENTS

JP 2004286362 A * 10/2004 ..... F23D 14/10
JP 2008118973 A * 5/2008 ..... F23D 14/10

* cited by examiner

RIBBON PACK FOR GAS BURNERS

TECHNICAL FIELD

The present disclosure is directed generally to components for gas burners, and more specifically, to replaceable ribbon packs for gas burners.

BACKGROUND

Gas burners are utilized to generate a flame to heat a product using a gaseous fuel such as acetylene, natural gas, and/or propane, among other fuel sources. The product being heated can be any product. Often, burners are built to individual requirements of either the application or the oven in which they are being utilized. Typically, the burner is designed to provide an even heat release along the burner's length.

One type of gas burners is the ribbon burner. Ribbon burners achieve more effective combustion by significantly increasing the surface area within the burner. For example, tube burners without ribbons may not provide sufficient time for a fuel or mixture to completely burn, so increasing the surface area with ribbons increases fuel consumption and burner efficiency. Ribbon burners are often utilized in heating units where a narrow, uniform sheet or ribbon of flame is desired.

Ribbons are typically manufactured of stainless steel or a similar metal, and are typically placed in groups of multiple ribbons within a gas burner. For example, a plurality of ribbons can be aligned next to each other and then bolted or otherwise connected to each other and then placed in the gas burner during manufacture. This construction results in the increased surface area and increased efficiency observed with ribbon burners. However, the structure of the ribbons is often negatively altered when they are bolted together or bolted into the gas burner, potentially reducing the surface area and efficacy of the ribbons.

Further, in order to replace the gas burner ribbons—often called a ribbon pack—in a ribbon burner, the burner may have to be returned to the manufacturer, disassembled, and the ribbon pack replaced before being shipped back to the customer. Alternatively, the burner might have to be completely replaced when the ribbon pack needs to be replaced, regardless of the state of the gas burner itself.

Accordingly, there is a need in the art for systems and methods of bundling ribbon packs together and into gas burners. Further, there is a need in the art for a system and method that enables the quick and easy replacement of ribbon packs in a gas burner.

SUMMARY

The present disclosure is directed to a ribbon pack for gas burners. Various embodiments and implementations herein are directed to a ribbon pack configuration and structure that provides easy installation into and removal from an existing gas burner, thereby increasing efficiency and enabling use of one of a variety of different ribbon packs.

Generally, in one aspect, a gas burner system is provided. The gas burner system includes a longitudinal burner body defining a longitudinal central cavity; and a ribbon pack configured to be removably installed into the central cavity, the ribbon pack comprising: (i) at least one ribbon positioned between a first vertical wall and a second vertical wall; (ii) a first transverse arm extending horizontally outward from a first longitudinal side of the ribbon pack; (iii) a second transverse arm extending horizontally outward from a second longitudinal side of the ribbon pack, wherein the first and second transverse arms are configured to attach to the longitudinal burner body.

According to an embodiment, the longitudinal burner body comprises a plurality of ribbon pack connection holes positioned along at least one side of the longitudinal central cavity, and at least one of the first and second transverse arms comprises a plurality of burner body connection holes, the plurality of ribbon pack connection holes and the plurality of burner body connection holes configured to align and receive a connection means to reversibly affix the ribbon pack to the burner body.

According to an embodiment, the ribbon pack further comprises an adjusting bolt, and the first vertical wall defines a hole configured to receive the adjusting bolt.

According to an embodiment, the ribbon pack further comprises a thread positioned in or on the second vertical wall, the thread configured to receive an end of the adjusting bolt.

According to an embodiment, the ribbon pack further comprises a deckle.

According to an embodiment, the burner body further defines a cooling channel.

According to an embodiment, wherein the burner body is extruded aluminum.

According to another aspect is a replaceable ribbon pack for a gas burner system. The ribbon pack includes at least one ribbon positioned between a first vertical wall and a second vertical wall; a first transverse arm extending horizontally outward from a first longitudinal side of the ribbon pack; and a second transverse arm extending horizontally outward from a second longitudinal side of the ribbon pack, wherein the first and second transverse arms are configured to attach to a longitudinal burner body of the gas burner system.

According to an embodiment, the ribbon pack is configured to be removably installed into a central cavity of the longitudinal burner body of the gas burner system.

According to another aspect is a method for installing a ribbon pack in a gas burner. The method includes the steps of: providing a ribbon pack comprising: (i) at least one ribbon positioned between a first vertical wall and a second vertical wall; (ii) a first transverse arm extending horizontally outward from a first longitudinal side of the ribbon pack; and (iii) a second transverse arm extending horizontally outward from a second longitudinal side of the ribbon pack, wherein the first and second transverse arms are configured to attach to a longitudinal burner body of the gas burner system; inserting the ribbon pack into a longitudinal central cavity of a burner body; and affixing the ribbon pack to the burner body.

According to an embodiment, the method further includes the step of removing the ribbon pack from the burner body. According to an embodiment, the method further includes the step of installing a new ribbon pack in the burner body.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects will be apparent from and elucidated with reference to the embodiment(s) described hereinafter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure.

DETAILED DESCRIPTION OF EMBODIMENTS

The present disclosure is directed to methods and systems for ribbon packs for gas burners. It would be beneficial to provide, for example, an easily removable and replaceable ribbon pack. A particular goal of utilization of certain embodiments of the present disclosure is to provide a gas burner device or system that carefully packages a plurality of ribbons into a ribbon pack that is then installed into and connected to the gas burner. When the ribbon pack needs to be replaced, it can easily be disconnected from and removed from the gas burner.

Figure 1:
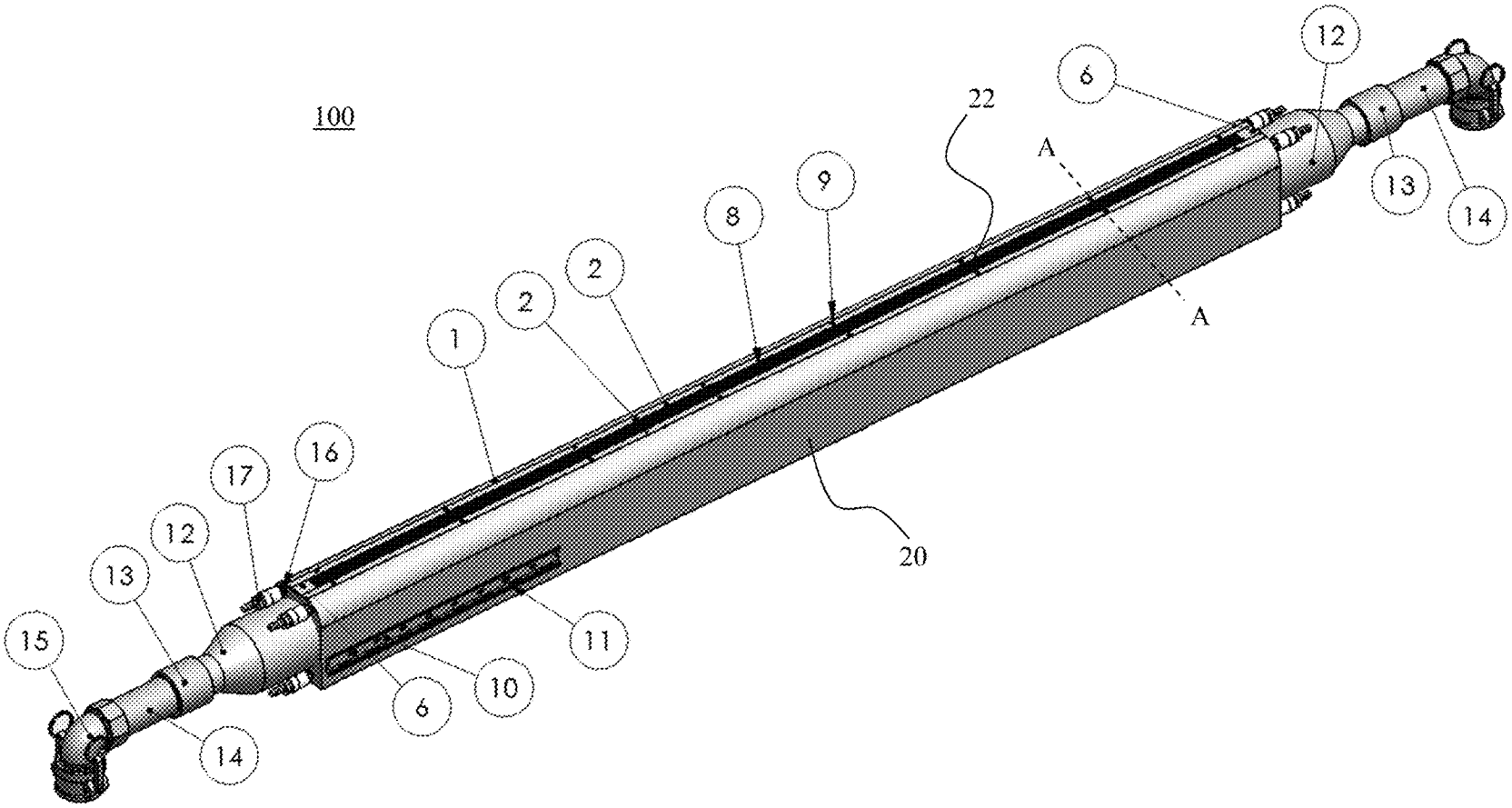
FIG. 1 is a schematic representation of a gas burner system, in accordance with an embodiment.

Referring to FIG. 1, in one embodiment, is a gas burner system 100 with a gas burner 20 and a replaceable ribbon pack 22. The gas burner comprises a burner body 1, which can adopt a wide variety of shapes and sizes depending on factors including, but not limited to, the system in which the burner will be utilized, the heating requirements for the system, and others. According to an embodiment, the gas burner 20 includes a mounting component or system configured to allow mounting of the burner body on or in a heating system. For example, as shown in FIG. 1, the burner body 1 includes a mounting rail 10 with one or more mounting bolts 11, which can be utilized to mount the mounting rail 10 to the burner body. The ignitor or flame supervision device can be mounted to this rail via brackets. In order to fit for different flame space, the bracket can be designed to slide on the rail, and the brackets can be installed or uninstalled by pushing clips. Although shown with a specific configuration in FIG. 1, the mounting system can take many different forms and configurations.

According to an embodiment, the burner body 1 of the gas burner system is an extruded body. For example, the extruded body can be extruded aluminum, among many other possible metals or materials.

The gas burner 20 can also include one or more components configured to enable operation of the burner. These components may be part of the heating system into which the burner is installed, or may be part of the gas burner itself such that the burner and accompanying components are installed together. According to an embodiment, the gas burner 20 includes at one or both ends of the burner body a reducing nipple 12, a pipe coupling 13, nipple 14, and gas supply connection 15. According to an embodiment, components 12, 13, 14, and/or 15 can form a connection to which the burner body is connected to a gas supply and components 16 and 17 can form a connection by which the burner body is connected to the cooling pipe. For example, the burner body can comprise bolts for connection, or slots or holes that enable connection by bolts. Many other connection mechanisms are possible. For example, as shown in FIG. 2 without components 12, 13, 14, and 15, the end of the burner body 1 comprises a plurality of holes or slots that enable a connection to the components and/or to the heating system.

Figure 2:
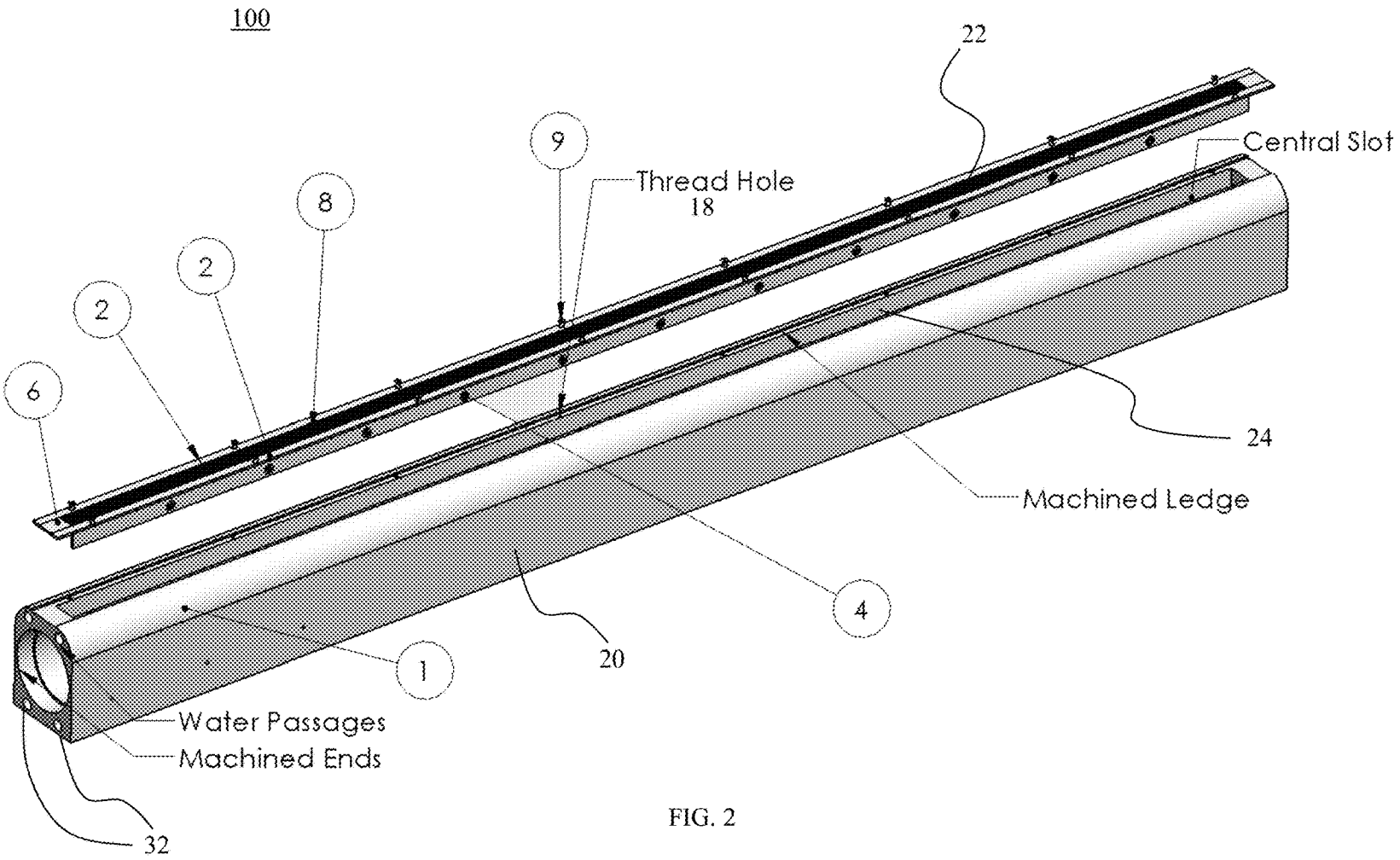
FIG. 2 is an exploded view of a gas burner and ribbon pack, in accordance with an embodiment.

Referring to FIG. 2 is a partially exploded view of the gas burner system 100 of FIG. 1. The gas burner system 100 comprises a burner body 20 and a ribbon pack 22 which is shown as it is being installed or uninstalled. The burner body 20 comprises a slot 24 into which the ribbon pack 22 will be positioned when it is installed. The slot 24 can be configured to receive a specific ribbon pack, or can be configured to receive a variety of different ribbon packs.

According to an embodiment, the ribbon pack 22 comprises two transverse arms 2 which are formed at a right angle to the long axis of the ribbon pack 22. The two transverse arms 2 are located at the top of the ribbon pack, and enable the connection with the burner body 1 as described elsewhere herein in greater detail. For example, the two transverse arms 2 each comprise a plurality of holes into which a fastening bolt 9 is positioned, which aligns with a thread hole 18. The fastening bolt is screwed or fastened into the thread hole 18 to hold the ribbon pack in place. To remove the ribbon pack, each of the fastening bolts 9 are unscrewed or otherwise unfastened from the thread holes 18.

The ribbon pack 22 also comprises one or more ribbons, with the count being dependent upon a variety of factors including but not limited to the heat input requirement of the heating system, among others.

FIG. 2 also demonstrates that the burner body 1 can include one or more cooling passages to connect to a cooling water or air supply. The coolant fluid or gas enters the burner body 1 at one or more cooling openings 32, flows throughout the burner body, and can exit the burner body via the one or more cooling openings 32, or via different openings or exits. The cooling passages can be connected in any way or order to provide efficient cooling when the burner is firing and the cooled burner body keeps the controlled temperature which prevents the deformation of burner body.

Figure 3:
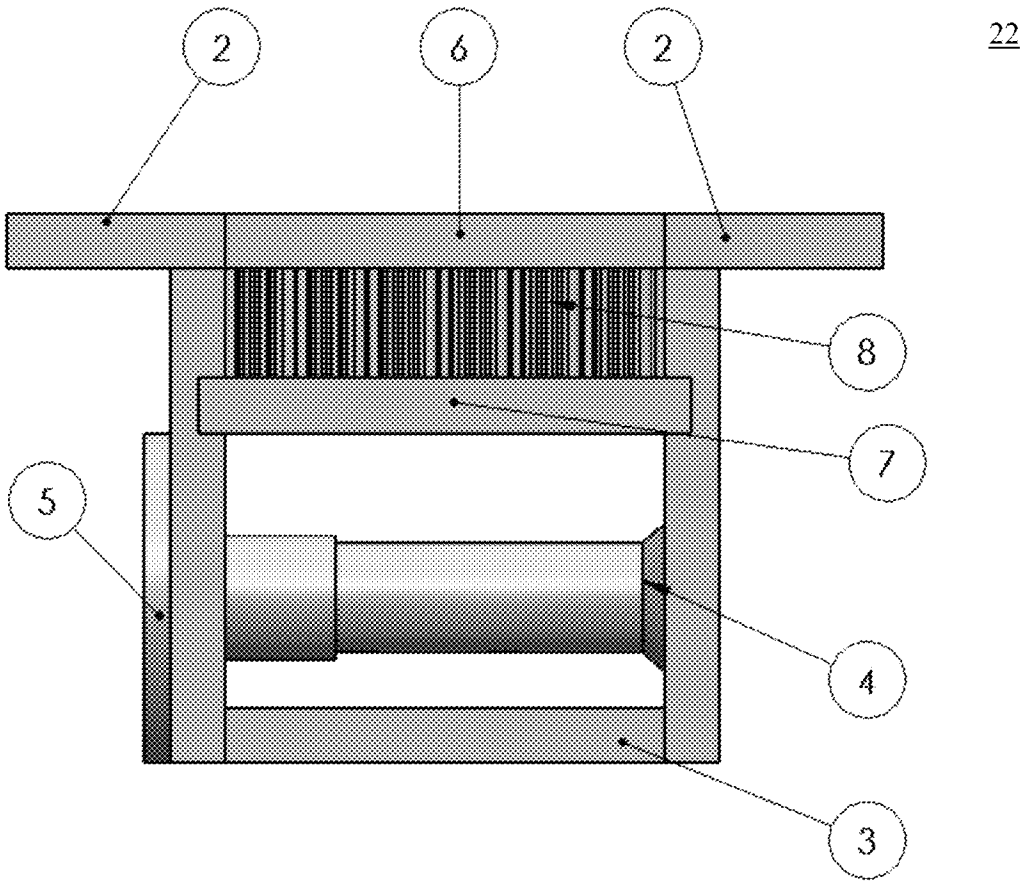
FIG. 3 is a cross-sectional view of a ribbon pack, in accordance with an embodiment.

Referring to FIG. 3, in one embodiment, is a cross-section of ribbon pack 22 taken along axis A-A of FIG. 1. According to an embodiment, ribbon pack 22 comprises a body formed by two vertical sides separated by top metal spacer 6 and bottom metal spacer 3. The metal spacers 3 and 6 determine the distance between the two vertical sides, and define the internal space for the one or more ribbons 8. The top metal spacer 6 is connected or adjoining the two transverse arms 2 which extend outwardly from the top of the ribbon pack. The ribbon pack also comprises a metal deckle 7, an adjusting bolt 4, and an adjustable thread binding 5.

Figure 4:
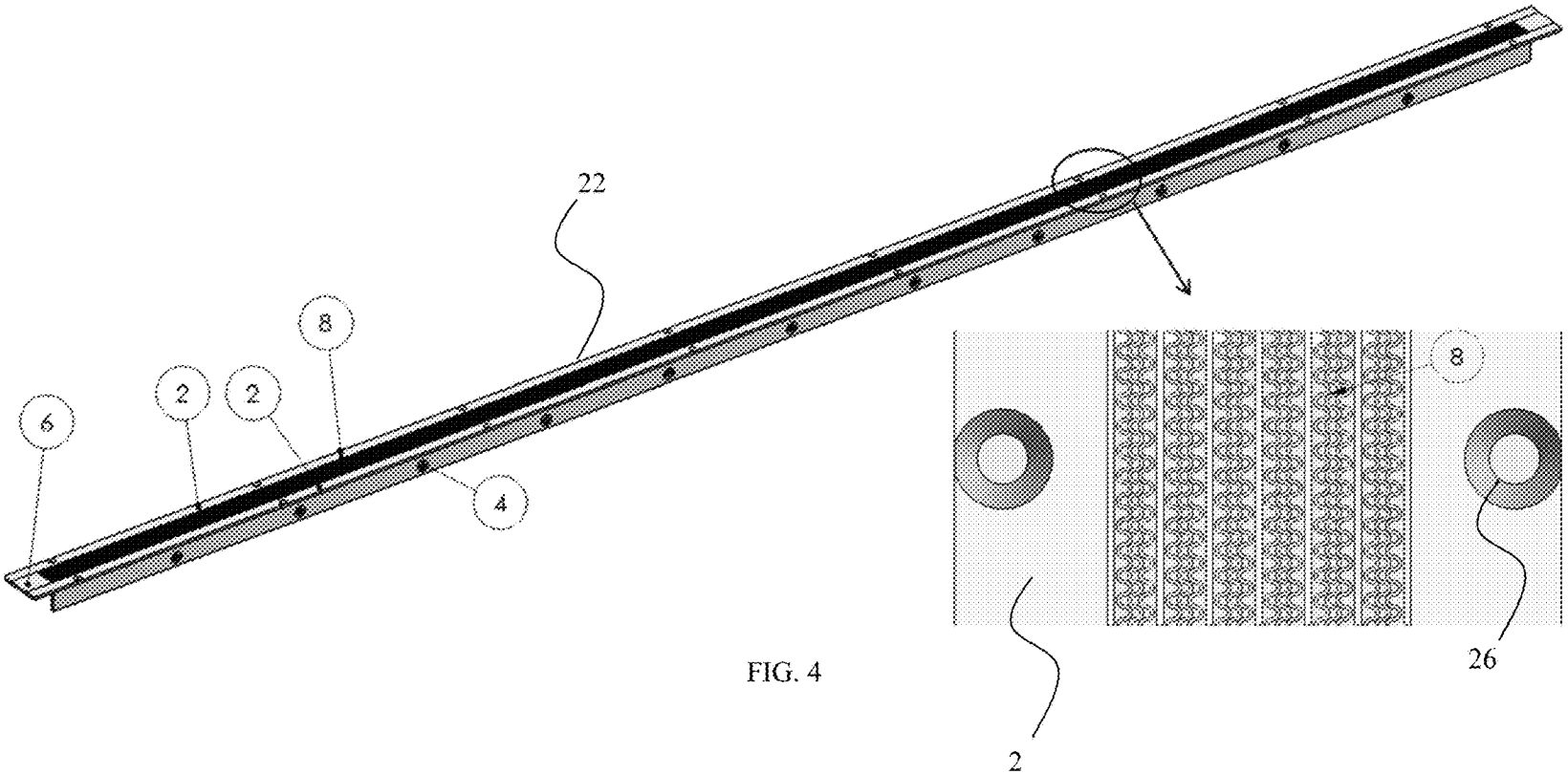
FIG. 4 is a side perspective view of a ribbon pack, in accordance with an embodiment.

Referring to FIG. 4, in one embodiment, is a perspective view of the ribbon pack 22 of the gas burner system 100. The ribbon pack 22 comprises a top metal spacer 6, which may be formed, for example, over a portion of the ribbon pack 22. The ribbon pack 22 also comprises two transverse arms 2 which extend outwardly from the top of the ribbon pack, with a plurality of holes 26 through which the fastening bolts 9 are inserted to mate with the thread holes 18. Also shown in FIG. 4 is the end of the adjusting bolt 4 in the side wall of the ribbon pack 22. On the other side wall of the ribbon pack aligning with the adjusting bolt 4, although not shown in this image, is the adjustable thread binding 5.

The insert in FIG. 4 is a top view of the ribbon pack, with two transverse arms 2 which extend outwardly from the top of the ribbon pack, the two arms comprise holes 26 through which the fastening bolts 9 are inserted to mate with the thread holes 18. The top view of the ribbon pack also shows the ribbons 8. In this particular embodiment there are eighteen ribbons, but there can be either more or fewer than eighteen ribbons.

Figure 5:
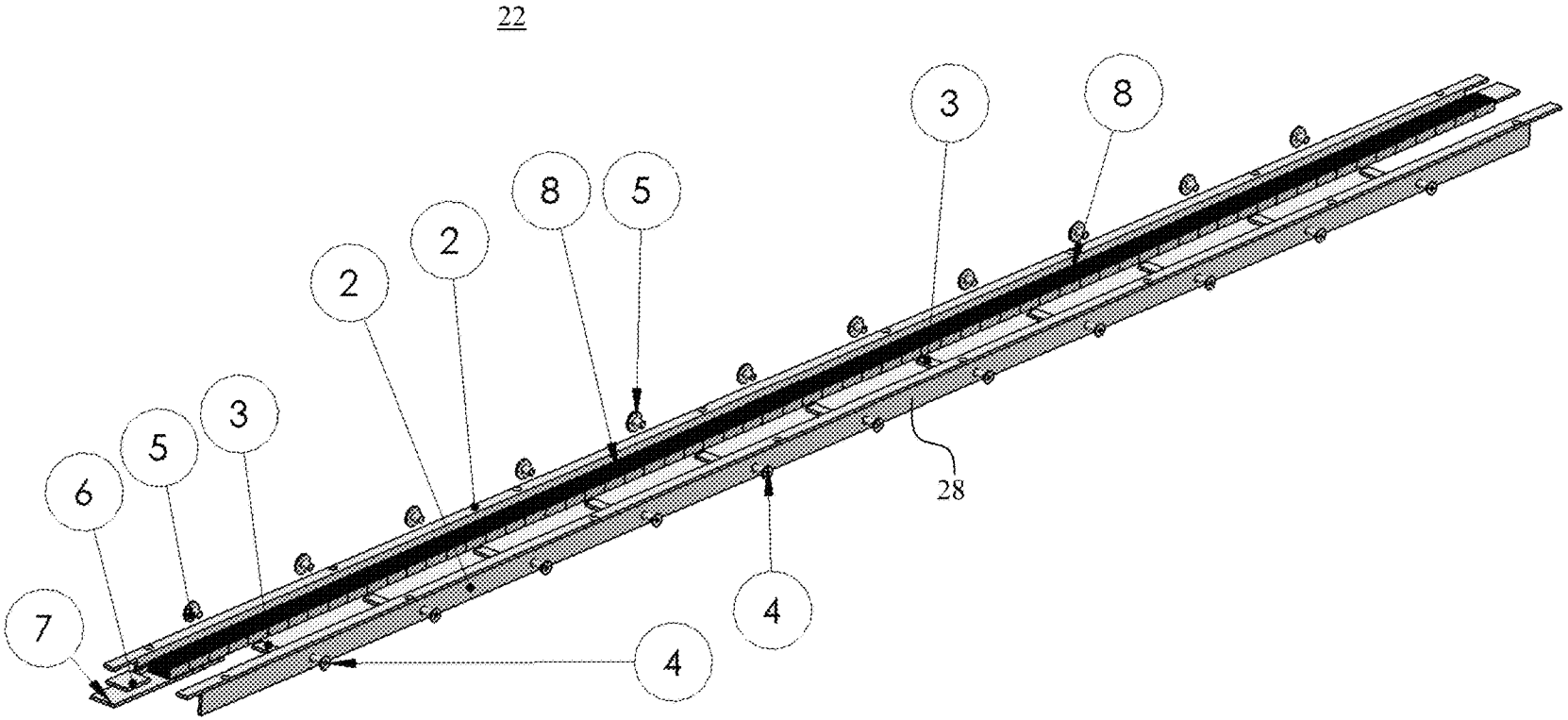
FIG. 5 is an exploded view of a ribbon pack, in accordance with an embodiment.

Referring to FIG. 5, in one embodiment, is an exploded view of the ribbon pack 22. The ribbon pack comprises two side walls with a vertical portion 28 and a transverse arm 2 which extends outwardly away from the ribbons 8. The two transverse arms 2 each comprise a plurality of holes into which a fastening bolt 9 is positioned, which aligns with a thread hole 18. The fastening bolt is screwed or fastened into the thread hole 18 to hold the ribbon pack in place. The ribbon pack also comprises one or more top spacers 6 and a plurality of bottom spacers 3. Also shown is a metal deckle 7.

According to an embodiment, the ribbon pack comprises a connection mechanism that connects the two sides of the ribbon pack together, thereby trapping the ribbons 8 in place without damaging or altering the structure of the ribbons. As shown in FIG. 5, the connection mechanism comprises a plurality of adjusting bolts 4 connected to adjusting thread binding 5, although other connection mechanisms are possible. Ribbon pack 22 in FIG. 5 comprises one or more ribbons, with the count being dependent upon a variety of factors including but not limited to the heat input requirement of the heating system, among others.

Figure 6:
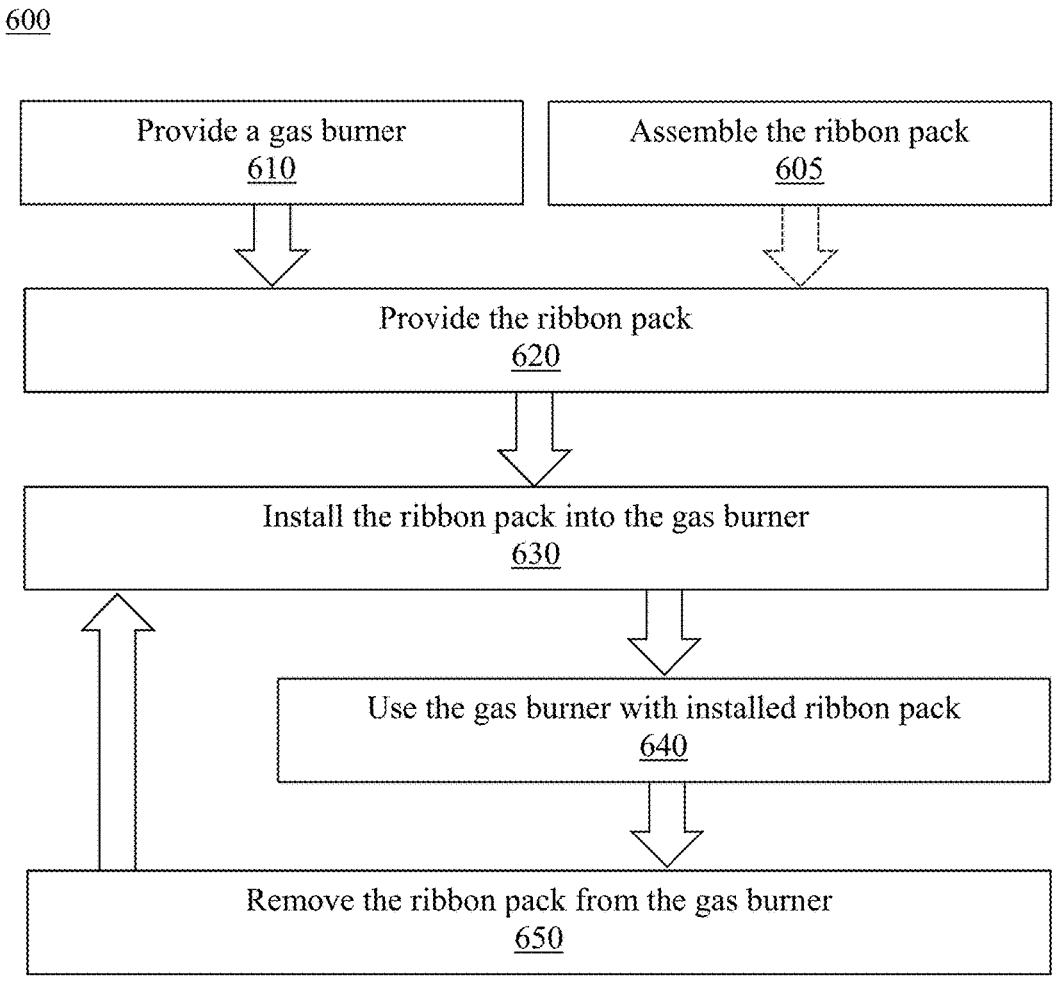
FIG. 6 is a flowchart of a method for installing a ribbon pack into a gas burner, in accordance with an embodiment.

Referring to FIG. 6, in one embodiment, is a method for installing a replaceable ribbon pack 22 into a gas burner system 100 with a burner body 1. At step 610, a gas burner 20 is provided, and at step 620 a replaceable ribbon pack 22 with one or more ribbons 8 is provided. The gas burner 20 and ribbon pack 22 can be any of the gas burners and ribbon packs described or otherwise envisioned herein. For example, according to an embodiment the burner body 1 can be extruded with aluminum or other material and the surface of burner body can be treated to prevent corrosion. The burner body 1 can include one or more cooling passages to connect to a cooling water or air supply. The burner body 1 can also provide a mechanical connection for the gas supply from either or both ends, which can be machined to connect the gas and air mixture supply. According to an embodiment, for example, the gas and air mixture are introduced from either or both ends of the burner and the seamless connection between gas feeding and burner body 1 is designed to lessen or avoid the risk of gas leaking. A gas feeding pipe 12 and its pipe fitting parts are designed to provide smooth flow to the burner and uniform gas flow distribution along the length of the burner slot.

As described above, there are three primary components that comprise the ribbon pack: transverse arms 2, one or more ribbons 8, and adjustable thread bindings 5. The two transverse arms 2 can be welded by spacer metal 3 and 6, and the sheet flame ribbons 8 can be inserted between. The adjusting bolt 4 passes through beneath the ribbons and threads in the adjustable thread binding 5 to tighten the ribbon pack firmly to hold the ribbon.

According to an optional step 605, the ribbon pack is assembled on site or at a different site from the manufacture or location of the gas burner. The ribbons 8 are held by transverse arms 2 and clamped by adjusting bolts 5, which allows the ribbons to be easily replaced by loosening the adjusting bolts. All assembly parts of the ribbon pack are underneath the ribbons, and thus these components do not disturb flame characteristics. Metal deckle 7 can be installed above or below the ribbons to block the flame and thus the varying flame space can be achieved upon application requirement. According to an embodiment, therefore, a plurality of ribbons can be aligned next to each other and then bolted or otherwise connected to each other and then placed in the gas burner during manufacture.

At step 630 of the method, the ribbon pack 22 is installed into the gas burner 20. For example, according to an embodiment, the ribbon pack is completely manufactured as a whole part and is mounted to the burner body via a mechanical linkage as described or envisioned herein. The burner body slot can be manufactured and/or machined to be larger than the ribbon pack, which allows the ribbon pack to easily fit into and be withdrawn from the ribbon pack slot. Thus, the ribbon pack can be easily installed to the burner body 1 by applying firmly mechanical linkage or uninstalled from the burner body 1 by removing the mechanical linkage.

According to an embodiment, for example, the two transverse arms 2 of the ribbon pack each comprise a plurality of holes into which a fastening bolt 9 is positioned, which aligns with a thread hole 18 on the burner body 1. Each of the plurality of fastening bolts is then screwed or fastened into a respective one of the plurality of thread holes 18 to hold the ribbon pack in place.

Once the gas burner system 100 is assembled by installing the ribbon pack 22 into the gas burner 20, the system is ready to be utilized. Accordingly, at step 640 of the method, the gas burner system 100 is used. According to an embodiment, the gas burner system 100 described or otherwise envisioned herein has a wide variety of applications. For example, the gas burner system with a replaceable ribbon pack can be utilized for lamination, searing decontamination, singeing, linear plastic 2D, metal foil, surface modification, converting, preheating, and a wide variety of other uses and application.

At step 650 of the method, the ribbon pack is removed when the ribbon pack requires replacement due to long-term use or due to different utilization requirements. For example, the ribbons in the ribbon pack might be corroded, damaged, or otherwise need replacement. Alternatively, the gas burner might be used for a different purpose which requires a different ribbon pack of a different size, shape, number or shape of ribbons, among many other possible variations. Removing the ribbon pack can comprise, for example, removing each of the plurality of fastening bolts on the transverse arms from each of the respective thread holes 18 on the burner body. When all the fastening bolts are removed, the ribbon pack can easily be lifted out of the burner body.

Returning to step 630, the cleaned or new ribbon pack is installed in the gas burner body. As described above, according to an embodiment the two transverse arms 2 of the ribbon pack each comprise a plurality of holes into which a fastening bolt 9 is positioned, which aligns with a thread hole 18 on the burner body 1. Each of the plurality of fastening bolts is then screwed or fastened into a respective one of the plurality of thread holes 18 to hold the ribbon pack in place.

According to an embodiment, the gas burner system 100 provides numerous advantages. As one advantage, the ribbon(s) and/or ribbon pack is easily removable within a couple of minutes without any special tools, devices, or systems. Additionally, because the ribbon(s) and/or ribbon pack are easily installed and removable, the burner can accommodate a variety of different ribbon pack sizes and configurations. Thus, a wide heat input is possible. The ribbon pack also has no impact on the free flow of the air and gas mixture, and does not disrupt the uniformity of the flame. Further, the ribbons can easily and quickly be cleaned, therefore saving both time and money.

While several inventive embodiments have been described and illustrated herein, those of ordinary skill in the art will readily envision a variety of other structures for performing the function or obtaining the results described herein, and each of these variations or modifications are within the scope of the inventive embodiments described herein. All definitions as defined and used herein should be understood to control over dictionary definitions and/or ordinary meanings of the defined terms.

What is claimed is:

1. A gas burner system, the system comprising:

a longitudinal burner body, the burner body defining a longitudinal central cavity; and a ribbon pack configured to be removably installed into the central cavity, the ribbon pack comprising: (i) at least one ribbon positioned between a first vertical wall and a second vertical wall; (ii) a first transverse arm extending horizontally outward from a first longitudinal side of the ribbon pack; (iii) a second transverse arm extending horizontally outward from a second longitudinal side of the ribbon pack, wherein the first and second transverse arms are configured to attach to the longitudinal burner body.

2. The gas burner system of claim 1, wherein the longitudinal burner body comprises a plurality of ribbon pack connection holes positioned along at least one side of the longitudinal central cavity, and wherein at least one of the first and second transverse arms comprises a plurality of burner body connection holes, the plurality of ribbon pack connection holes and the plurality of burner body connection holes configured to align and receive a connection means to reversibly affix the ribbon pack to the burner body.

3. The gas burner system of claim 1, wherein the ribbon pack further comprises an adjusting bolt, and wherein the first vertical wall defines a hole configured to receive the adjusting bolt.

4. The gas burner system of claim 3, wherein the ribbon pack further comprises a thread positioned in or on the second vertical wall, the thread configured to receive an end of the adjusting bolt.

5. The gas burner system of claim 1, wherein the ribbon pack further comprises a deckle.

6. The gas burner system of claim 1, wherein the burner body further defines a cooling channel.

7. The gas burner system of claim 1, wherein the burner body is one piece, and is composed of extruded aluminum.

8. A replaceable ribbon pack for a gas burner system, the ribbon pack comprising:

at least one ribbon positioned between a first vertical wall and a second vertical wall;

a first transverse arm extending horizontally outward from a first longitudinal side of the ribbon pack; and a second transverse arm extending horizontally outward from a second longitudinal side of the ribbon pack, wherein the first and second transverse arms are configured to attach to a longitudinal burner body of the gas burner system.

9. The ribbon pack of claim 8, wherein the ribbon pack is configured to be removably installed into a central cavity of the longitudinal burner body of the gas burner system.

10. The ribbon pack of claim 8, wherein at least one of the first and second transverse arms comprises a plurality of burner body connection holes configured to align with a plurality of connection holes in the burner body.

11. The ribbon pack of claim 8, further comprising:

an adjusting bolt, wherein the first vertical wall defines a hole configured to receive the adjusting bolt.

12. The ribbon pack of claim 11, further comprising a thread positioned in or on the second vertical wall, the thread configured to receive an end of the adjusting bolt.

13. The ribbon pack of claim 11, further comprising a deckle.

14. A method for installing a ribbon pack in a gas burner, the method comprising the steps of:

providing a ribbon pack comprising: (i) at least one ribbon positioned between a first vertical wall and a second vertical wall; (ii) a first transverse arm extending horizontally outward from a first longitudinal side of the ribbon pack; and (iii) a second transverse arm extending horizontally outward from a second longitudinal side of the ribbon pack, wherein the first and second transverse arms are configured to attach to a longitudinal burner body of the gas burner system;

inserting the ribbon pack into a longitudinal central cavity of a burner body; and affixing the ribbon pack to the burner body.

15. The method of claim 14, wherein at least one of the first and second transverse arms comprises a plurality of burner body connection holes configured to align with a plurality of connection holes in the burner body.

16. The method of claim 14, wherein the ribbon pack further comprises an adjusting bolt, and wherein the first vertical wall defines a hole configured to receive the adjusting bolt.

17. The method of claim 16, wherein the ribbon pack further comprises a thread positioned in or on the second vertical wall, the thread configured to receive an end of the adjusting bolt.

18. The method of claim 14, wherein the burner body further defines a cooling channel.

19. The method of claim 14, further comprising the step of removing the ribbon pack from the burner body.

20. The method of claim 19, further comprising the step of installing a new ribbon pack in the burner body.

* * * * *